US005720348A

United States Patent [19]

Hisaw

[11] Patent Number: 5,720,348

[45] Date of Patent: Feb. 24, 1998

[54] APPARATUS AND METHOD FOR CUTTING WIRE

[75] Inventor: Jack C. Hisaw, Carencro, La.

[73] Assignee: Specialty Machine & Supply, Inc., Scott, La.

[21] Appl. No.: 635,147

[22] Filed: Apr. 23, 1996

[51] Int. Cl.[6] ..... E21B 29/04

[52] U.S. Cl. ..... 166/297; 166/54.5; 166/54.6

[58] Field of Search ..... 166/54.5, 54.6, 166/277, 297; 43/17.2; 114/221 A

[56] References Cited

U.S. PATENT DOCUMENTS

| | | | |
|---|---|---|---|
| 2,825,536 | 3/1958 | Kenneday et al. | 166/54.5 |
| 3,193,013 | 7/1965 | Whiteside | 166/54.5 |
| 3,926,252 | 12/1975 | Ribeyre et al. | 166/54.6 |
| 4,427,059 | 1/1984 | Oliver | 166/54.6 |
| 4,512,411 | 4/1985 | Pringle | 166/54.5 |

OTHER PUBLICATIONS

Flopetrol Brochure, Special Tools Sec. VIII, p. 2.1 Feb. 1979 "Flopetrol Cable Cutter".

Flopetrol Brochure, Special Tools Sec. VIII, p. 3.1 Feb. 1979 "Kinley Cable Cutter".

*Primary Examiner*—George A. Suchfield

*Attorney, Agent, or Firm*—Domingue, Delaune & Waddell

[57] ABSTRACT

A device for cutting a wire line is disclosed. Generally, the device comprises a tubular member having an inner diameter therethrough for placement of the wire line. A power mandrel is associated with the tubular member. A housing is operatively associated with the mandrel. Also included will be a rotatable cutting blade pivotally attached to the housing, and selective attachment means (operatively associated with the mandrel and the housing) for selectively attaching the mandrel and the housing together. The device may contain an activating member for activating the rotatable cutting blade into engagement with the wire so as to cut the wire. The device may further comprise a wire wedge member, positioned within the mandrel slot, that is adapted to wedge the wire into engagement with the mandrel. In one embodiment, the rotatable cutting blade comprises a disc member having a channel therethrough for receiving the wire, with the channel having sides contoured to cut the wire.

13 Claims, 7 Drawing Sheets

APPARATUS AND METHOD FOR CUTTING WIRE

This invention relates to an apparatus and method for cutting wire. More particularly, the invention relates to an apparatus used in oil and gas well bores to sever a wire connected to a down hole tool. The invention also describes a novel method of cutting the wire.

In oil and gas well bores, the operator may deem it feasible to perform work within the well bore. The work is performed in a variety of manners and with a variety of devices. Many times, the work involves use of a wire line unit that has extending therefrom a wire and/or cable. The wire will have attached thereto a device that is used for the necessary well bore work.

Many times, during the course of the remedial work, the device becomes lodged within the well bore. The device is attached to the wire which runs all the way to the surface. As those of ordinary skill in the art will appreciate, the lodged device with wire extending therefrom is highly undesirable situation. Thus, the operators will commence retrieving operations (sometimes referred to as fishing) in order to retrieve the down hole object and wire line.

Prior art devices allow the operator to retrieve the object. Many times a wire cutter device is stripped onto the existing wire line. The wire cutter device is allowed to descend the well bore via the wire line until the down hole device is encountered. The jarring action of the wire cutter device impacting the down hole object triggers the cutter mechanism which in turn cuts the wire. Thereafter, the cutter device is retrieved.

The prior art devices, however, all suffer from inherent deficiencies. For instance, many prior art devices will cut the wire several inches above the down hole device. Thus, when the operator runs back into the well bore to retrieve the down hole device, the residual wire sticking up from the down hole device serves as an obstacle for the retrieving tool and in fact makes the retrieval difficult if not impossible.

Further, the prior art devices require the operator to first retrieve the wire from the well bore, allowing the wire cutting device to remain in the well bore. Then, the operator must run back in the well bore and retrieve the cutting device. Thereafter, the operator must run back in the well bore again in order to retrieve the down hole device. The three independent trips into the well bore is costly and time consuming.

The present invention solves these problems by allowing the cutting of the wire line very close to the fishing neck of the down hole device. Further, the novel invention herein disclosed wedges the wire cutter device with the wire so that the novel cutter device may be pulled out of the well bore at the same time as the wire. Thereafter, the down hole device may be retrieved from the well. Also, the present invention allows for the cutting of thick wire, cable and braided line. These and other objects will be more fully presented.

SUMMARY OF THE INVENTION

A device for cutting a wire line is disclosed. Generally, the device comprises a tubular member having a slot therethrough for placement of the wire line. A power mandrel having an a first end associated with the tubular member and a second end having a mandrel slot therein for placement of the wire line is provided. It should be noted that the term wire line is used to include wire line, cable, and braided line in various sizes. A housing is operatively associated with the mandrel, with the first end of the housing receiving the mandrel and the second end of the housing having an outlet for the wire line.

Also included will be a rotatable cutting blade pivotally attached to the housing, and selective attachment means (operatively associated with the mandrel and the housing) for selectively attaching the mandrel and the housing. The device may contain activating means for activating the rotatable cutting blade into engagement with the wire so as to cut the wire. The device may further comprise a wire wedge member, positioned within the mandrel slot, that is adapted to wedge the wire into engagement with the mandrel.

In one embodiment, the rotatable cutting blade comprises a disc member having a channel therethrough for receiving the wire, with the channel having sides contoured to cut the wire. A pivoting arm is included, with the pivoting arm being attached to the disc member so that the pivoting arm is operatively associated with the housing.

The device may also contain an embodiment wherein the housing contains an aperture, and wherein the selective attachment means comprises a pin adapted to be received within the aperture. The pin will selectively attach the housing with the mandrel.

In one embodiment, the activating means may comprise a conical shaped end formed on the power mandrel that is adapted to cooperation with the indentation profile contained on the disc member. Thus, as the conical end is lowered into the indentation profile, the cutting blade is rotated against the wire line and conical end thereby cutting the wire.

The invention may also include an embodiment wherein the wire wedge member is adapted for inclusion into the longitudinal slot of the mandrel. In this embodiment, the wedge has a first short end and a second longer end thereby forming a sloping side. The shorter end is adapted against the tubular member so that upon downward movement, the sloping side of the wire wedge member is wedged into the longitudinal slot of the mandrel thereby snaring the wire together with the device.

An advantage of the present invention includes cutting the wire in very close proximity to the lodged down hole object so that only a small length of wire is left protruding from the down hole object. Another advantage is that after the wire is cut, the entire cutter device may be retrieved from the well bore via the previously existing wire line in the well bore.

Yet another advantage includes the mandrel being able to advance through well bore fluid without losing momentum, and therefore, delivering a maximum of force against the down hole object. Still yet another advantage includes the design allows for creation of sufficient force that allows the penetrating of large outer diameter wire so that thick wire, including cable and braided line, may be cut.

A feature of the present invention includes a novel rotatable cutting blade that is mounted within the housing. Another feature includes the blade being activated by an activation means located on the mandrel.

Yet another advantage includes the activation means is a bull nose design that allows the mandrel to advance through a fluid column without losing momentum. Still yet another advantage includes the wedge member snares the wire without interfering with the velocity of the activation means because the wire is first cut, then the wedge member is activated.

DESCRIPTION OF THE PREFERRED EMBODIMENTS

Figure 1:
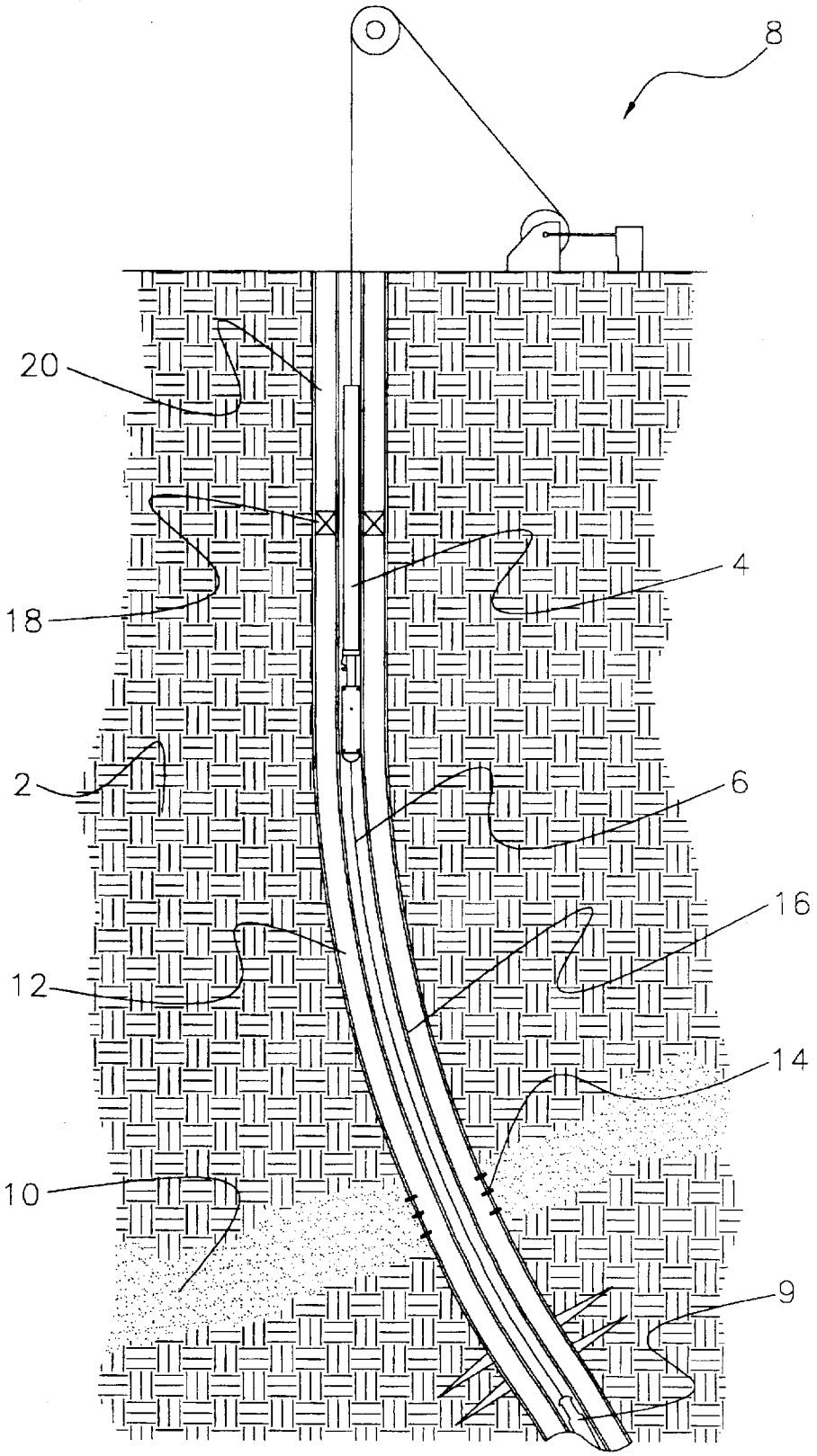
FIG. 1 is a schematic of a typical well bore with the invention being lowered on a wire line.

Referring now to FIG. 1, a typical well bore 2 with the apparatus 4 of the present invention being dropped into the well bore 2 on a wire line 6 is shown. The wire line unit 8 is located at the surface. As depicted in FIG. 1, the apparatus 4 is in the process of dropping to the down hole object 9 which has become lodged in the well bore 2. It should be noted that the down hole object 9 sometimes is referred to as a "fish".

The well bore 2 is generally a casing string that intersects various subterranean reservoirs. Some of the reservoirs will contain commercial deposits of hydrocarbons. The well bore 2 will be completed to the reservoir 10 with the reservoir fluids and gas being produced into the lower annulus 12 through the perforations 14.

The well bore 2 may contain a production tubing string 16 with a production packer 18 being operatively associated therewith so that an upper annulus 20 and lower annulus 12 is formed. The production string 16 may contain nipple profiles (not shown) for various remedial well work.

Generally, the operator will be conducting some type of remedial well work with the down hole object 9 via the wire line, as is well understood by those of ordinary skill in the art. During the course of the remedial well work, the down hole object 9 may become stuck for various reasons. For instance, scale or paraffin build-up on the inner diameter of the production tubing string 16, or dog-leg bends in the production tubing string 16, or collapsed production tubing string, etc may cause the down hole object 9 to become lodged. Since the situation of having a lodged object within the tubing 16 is highly undesirable, the operator will attempt to recover the wire (note: the down hole object 9 is still attached to the wire line) as well as the object 9.

Sometimes, the down hole object 9 can be recovered by pulling on the wire line from the surface. However, if an excessive pull is created, the wire line will separate, so that the wire will be allowed to slack-off in the production tubing 16 which is a highly undesirable situation.

Thus, before pulling excessively on the wire and severing the wire within the tubing string 16, the apparatus 4 of the present invention allows for the operator strip-over the wire line, lower the apparatus 4 so that the wire is cut immediately above the down hole object 9, and thereafter, retrieve the down hole object 9.

Figure 2:
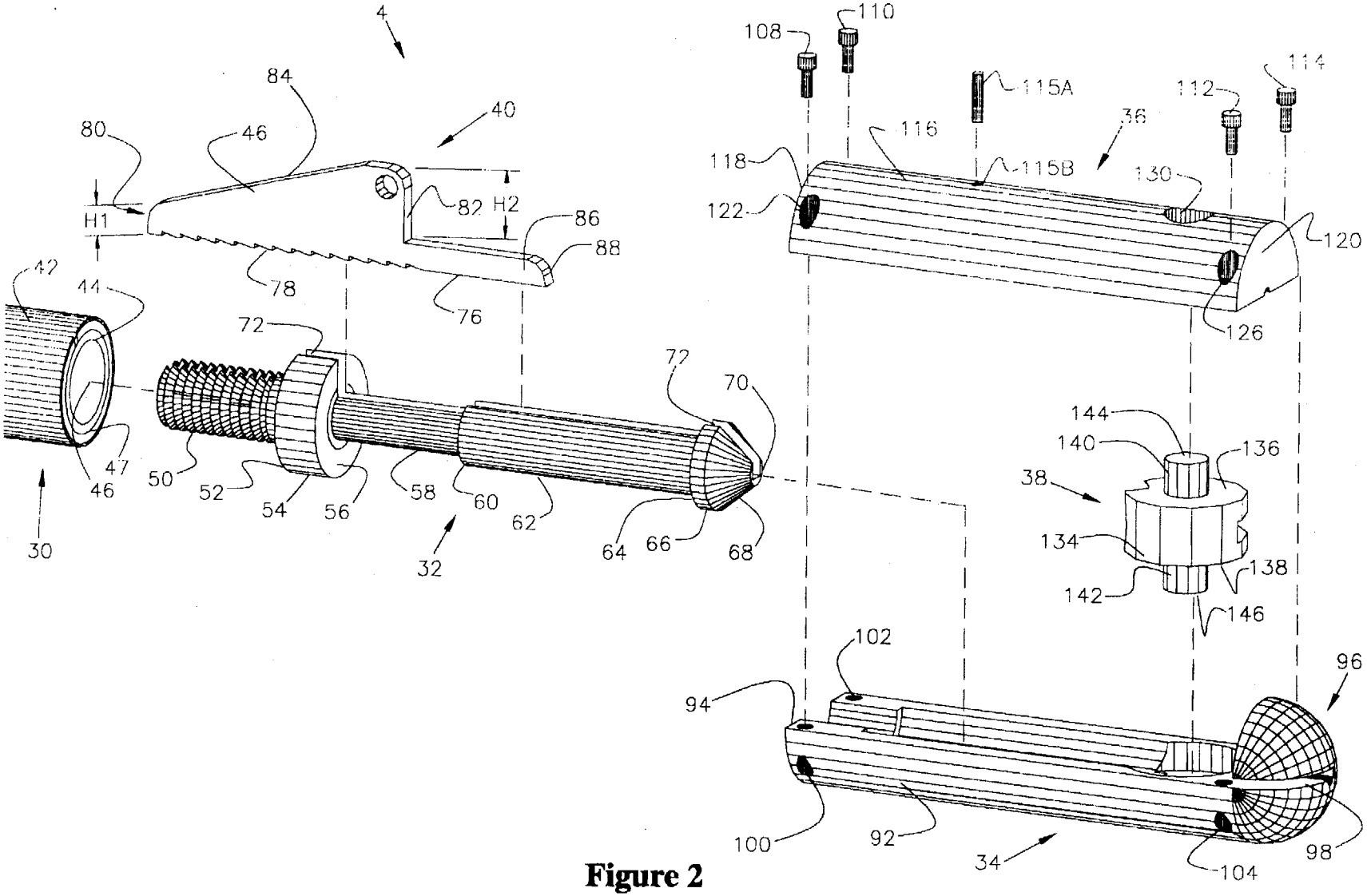
FIG. 2 is a disassembled illustrated view of the present invention.

Referring now to FIG. 2, a disassembled illustrated view of the apparatus 4 of the present invention is depicted. Generally, the apparatus 4 comprises a tubular member 30, and power mandrel 32, a housing having a first housing section 34 and a second housing section 36, as well as a cutting means 38 for cutting the wire line and a wire wedge member 40.

The tubular member 30, sometimes referred to by those of ordinary skill in the art as a go-devil, includes an outer cylindrical surface 42 that extends radially inward to the internal thread means 44. An internal bore 46 extends through the tubular member 30 for placement of the wire line. The tubular member will have the radial end 47. At the opposite end of the tubular member 30 will be the external thread means and fishing neck (not shown) as is well understood by those of ordinary skill in the art.

The power mandrel 32 contains external thread means 50 that cooperate with the internal thread means 44 of the tubular member. The external thread means 50 extend to the radial shoulder 52 which in turn extends to the cylindrical surface 54. The cylindrical surface 54 extends to the radial shoulder 56 which then stretches to the outer cylindrical surface 58. The outer cylindrical surface 58 stretches to the radial surface 60 that extends to the outer cylindrical surface 62. The surface 62 concludes at the radial end 64 that in turn extends to the activation means for activating the cutting means 38. In the preferred embodiment, the action means includes a outer cylindrical surface 66 and a conical surface 68, with the conical surface 68 concluding at the radial end 70. A longitudinal mandrel slot 72 runs the length of the power mandrel 32 for placement of the wire line. The activation means may sometimes be referred to as a bull nose 66, 68, 70.

Also seen in FIG. 2 is the wire wedge member 40. The wedge 40 comprises a wire side 76 that contains a serrated gripping profile means 78 for gripping the wire within the slot 72 as will be more fully set out later inthe application. The wedge 40 also contains a short side 80 having a H1, and a long side 82 having a height H2, and wherein H2 is longer than H1 so that the angled surface 84 is formed. The long side 82 has the leg 86 that extends to the rounded border end 88. The wedge's wire side 76 is adapted to be fitted into the slot 72 and cooperates with the wire as will be explained later in the application.

The apparatus 4 also contains the first housing section 34. Generally, the first housing section 34 is a semi-cylindrical member 34 having an outer cylindrical surface 92 that extends from a first radial end 94 (also referred to as an alignment edge) to a second end 96, the second end 96 being formed as a half-spherical member 96. The half-spherical member 96 contains the slotted portion 98 through which the wire will pass. The semi-cylindrical member 34 contains the apertures 100, 102, 104, (another aperture 106 is not shown due to this angle of FIG. 2) for the placement of the cap screws 108, 110, 112, 114 respectively, in cooperation with the second housing section 36. Extending radially inward of surface 92 is an internal recess profile so that the cutting means 38 and the activation means 68 may be positioned therein, as will be more fully explained in FIG. 4. A pin 115A will be fitted into the aperture 115B, with the pin 115A causing to selectively attach the power mandrel 32 and tubular member 30 as will be more fully explained. The pin may be referred to as the selectively attaching and detaching means.

The second housing section 36 is a semi-cylindrical member 36 cooperating with the semi-cylindrical member 34. The semi-cylindrical member 36 contains an outer cylindrical surface 116 that has a first radial end 118 and a second radial end 120. The outer cylindrical surface 116 will contain the apertures 122, 124, (two other apertures, 126, 128 are not shown due to the angle of FIG. 2) for placement of the previously mentioned cap screws 108, 110, 112, and 114. The radial end 120 will cooperate with the half-spherical member 96. The outer cylindrical surface 116 will also contain the opening 130 for placement of the leg of the cutting means 38, to be described hereinafter.

The cutting means 38, as seen in FIG. 2, comprises a cylindrical surface 134, with the cylindrical surface 134 extending to a first radial end 136 and a second radial end 138. A first pivoting arm 140 that extends from the radial end 136 and a second pivoting arm 142 that extends from the radial end 138.

The pivoting arm 140 contains the radial face 144, and the pivoting arm 142 contains the radial face 146. The pivoting arm 140 will extend to and cooperate with the opening 130. The pivoting arm 142 will extend to and cooperate with an opening (not shown) within the first housing section 34.

Figure 3B:
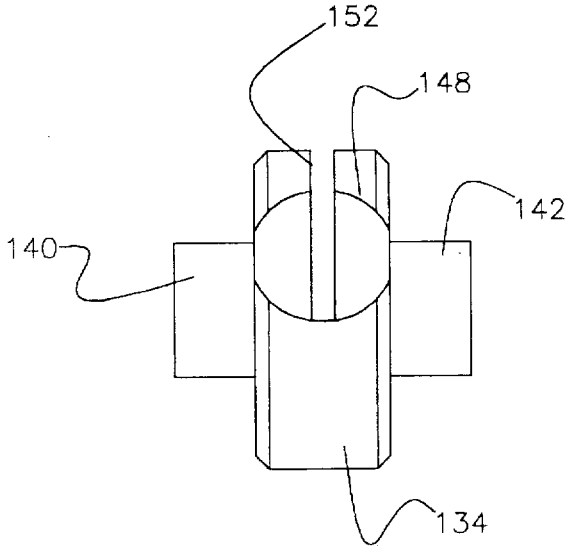
FIG. 3B is the top view of the cutting blade member of FIG. 3A.
Figure 3A:
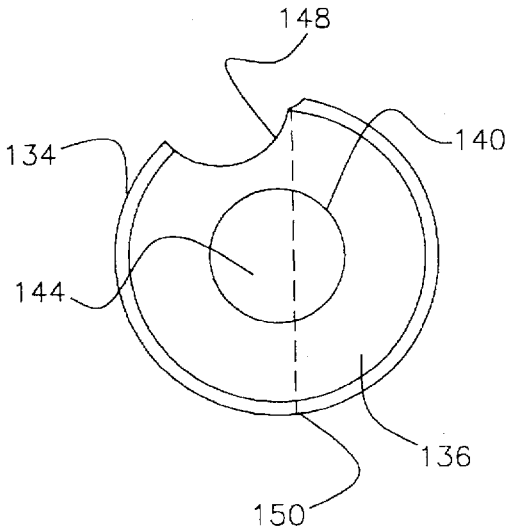
FIG. 3A is an enlarged partial sectional front view of the cutting blade member of the present invention.

Referring now to FIGS. 3A and 3B, the cutting means 38 will be further described. As shown in FIG. 3A, the cutting means includes the pivoting arm 140 that extends from the radial end 136. The cylindrical surface 134 contains an indention profile 148 that is sized to receive the conical end 68 of the power mandrel 32 (as is more fully described in FIGS. 5, 6, and 7). On the opposite perimeter will be the cutting blade 150

As shown in FIG. 3B, the cutting means 38, and in particular the cylindrical surface 134 contains the channel 152 for placement of the wire. The indentation profile perimeter, in the preferred embodiment, is circular, but other shapes are possible. The channel 152 runs through the cutting means 38 from the indention profile 148 to the cutting blade 150.

Figure 4:
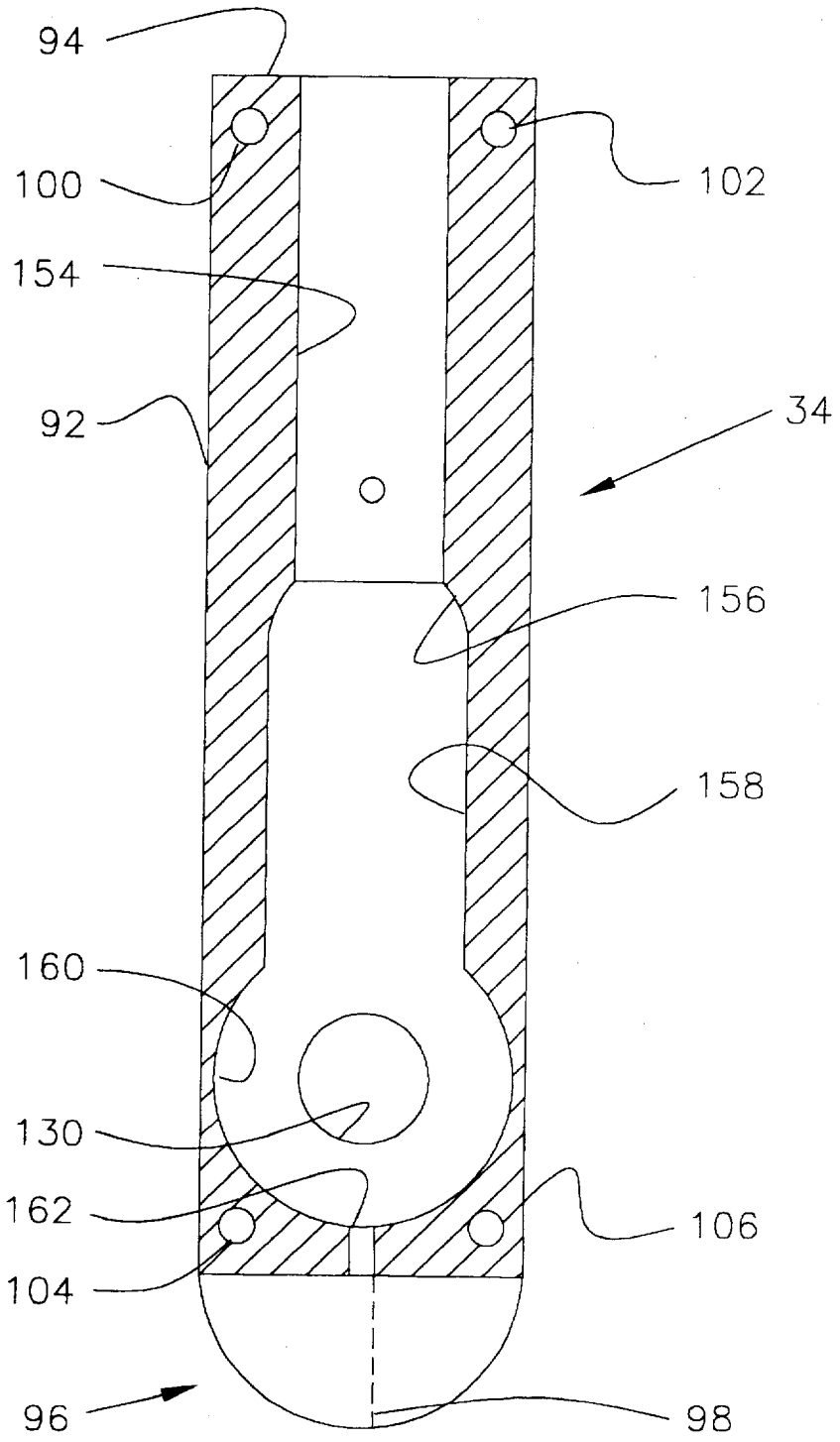
FIG. 4 is an enlarged partial sectional view of the housing member.

Referring now to FIG. 4, an enlarged partial sectional view of the housing member 34 is illustrated. Extending radially inward from the first radial end 94 will be the first inner bore surface 154 that extends to the angled surface 156 which in turn extends to the second inner bore surface 158. From the second inner bore surface 158, a cavity 160 is formed in the profile of the cutting means 38 so that the cylindrical surface 134 is adapted to be placed within the cavity 160. The lip 162 cooperates with the cutting blade 150 of the cutting means 38 as will be more fully explained hereinafter.

OPERATION

Figure 5:
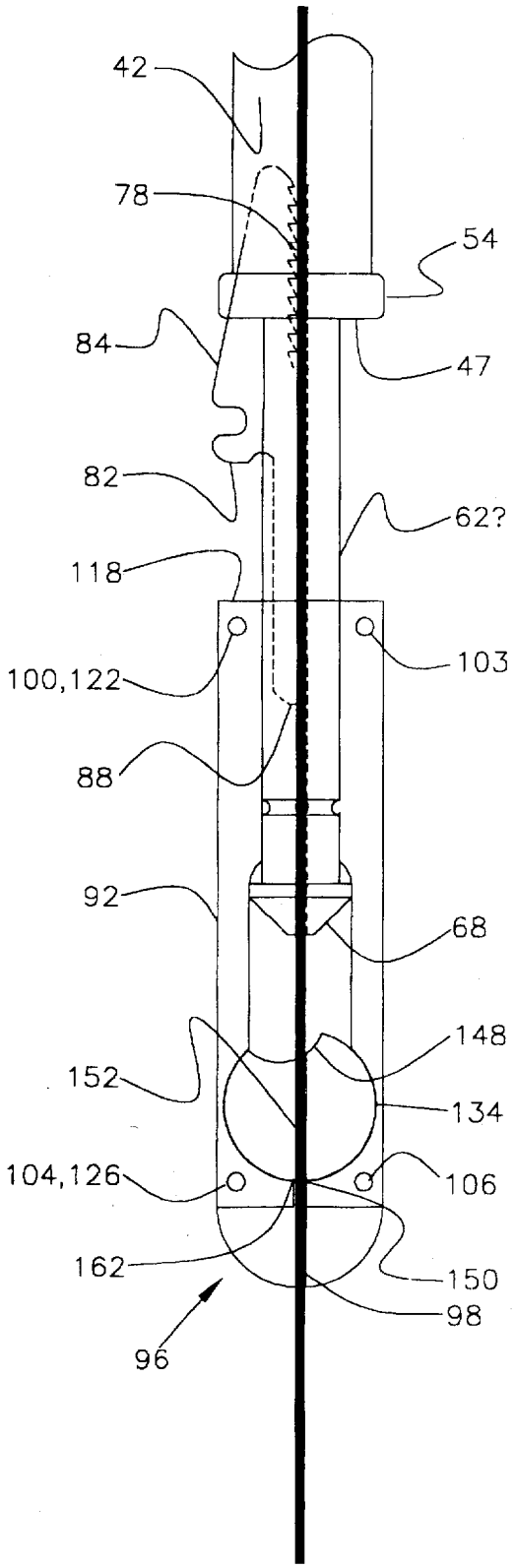
FIG. 5 is a cross-section of the invention in the run-in position.

The operation of the novel apparatus 4 will now be explained. As seen in FIG. 5, the apparatus 4 has been stripped onto a wire line. The preferred procedure for assembly onto the cable is as follows. First, assemble the tubular member 30 and power mandrel 32 with the longitudinal slots aligned. Second, strip over the wire and install the roll pins (not shown) and tighten the mandrel 32 and tubular member 30 together. Third, the operator will strip the cutting means 38 over the wire with the indentation profile 148 facing the conical surface 68. Fourth, the operator holds the first housing section 34 perpendicular to the wire and lines up the cutting means 38, and thereafter, turns 90 degrees wherein the wire should fall in slot 98. Fifth, the power mandrel 32 should line up as seen in FIG. 2.

Sixth, the wire wedge member 40 is installed into the mandrel longitudinal slot 72 with the angled surface 84 facing the tubular member 30. Seventh, the second housing section 36 is placed on top of the first housing section 34 and the two are attached via the cap screws 108, 110, 112, 114. Eight, the operator rotates the power mandrel 32 with the wire wedge member 40 so that when the pin 115A is placed therein the pin 115A does not fall into slot 72. Ninth, the operator will slide the power mandrel 32 in and out to properly orient the power mandrel 32 with the alignment edge 94 and hit pins 115A in place. The apparatus is in position to be lowered as seen in FIG. 5.

As noted earlier, the down hole object 162 may be lodged in the well bore. Therefore, the down hole object will be attached to the wire line, with the wire line extending from the down hole object to the surface. Thus, it is necessary for the operator to strip the apparatus 4 onto the wire line at the surface.

After stripping the apparatus onto the wire line at the surface, the operator will lower the apparatus 4 into the well bore. Generally, this is accomplish by simply allowing the apparatus to gravity fall into the well bore. The apparatus 4 will be lowered into the well bore in the position shown in FIG. 5. Thus, the first housing section 34 and the second housing section 36 are attached to one another via the cap screws 108, 110, 112, 114. The power mandrel 32 and the tubular housing 30 are threadedly attached with the thread means 50, 46.

The power mandrel 32 is selectively attached to the housing sections 34, 36 via the pin 115A. Thus, the power mandrel 32 and the housing section 34 are fixed with respect to each other. It should be noted that at the position shown in FIG. 5, the wedge member 40 is not engaged with the wire line so that the apparatus 4 is free to be lowered to the down hole object 162.

As depicted in FIG. 5, the channel 152 through the cutting means 38 is slightly skewed and off-centered with respect to the indention profile 148 and is due to the angle that the channel 152 is bored through the cutting means 38. This angle will enable the cutting means 38 to be rotated upon impact with the activation means 68 as will be more fully set out.

Figure 6:
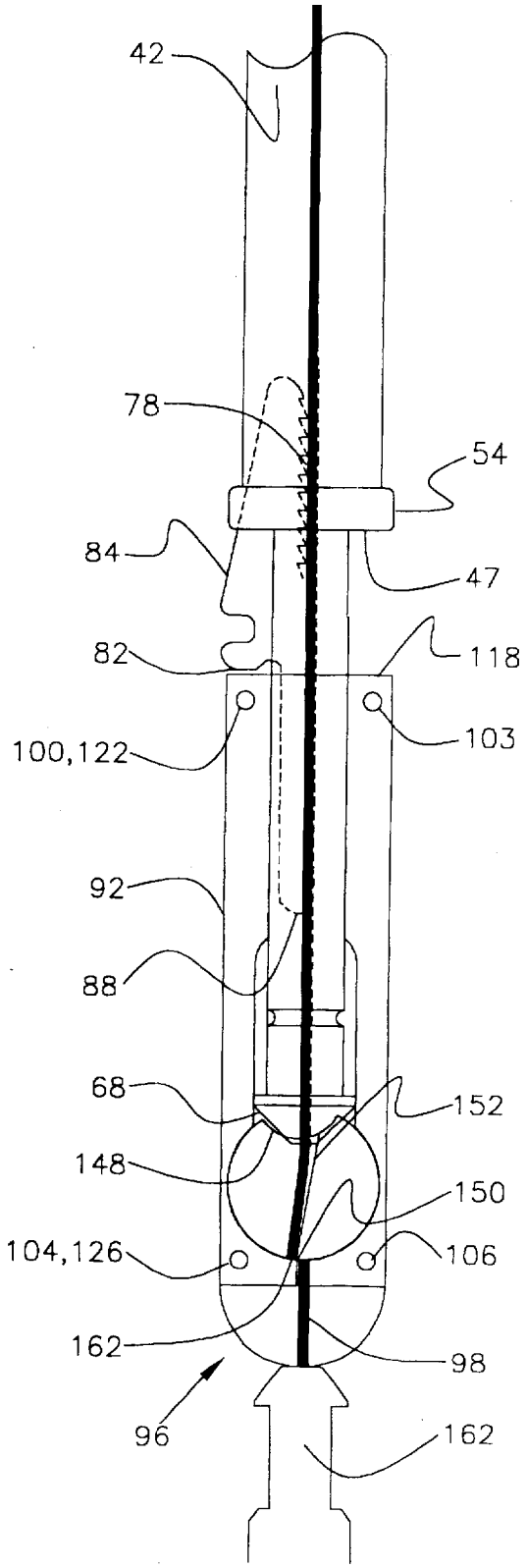
FIG. 6 is a cross-section of the invention in the cutting position.
Figure 7:
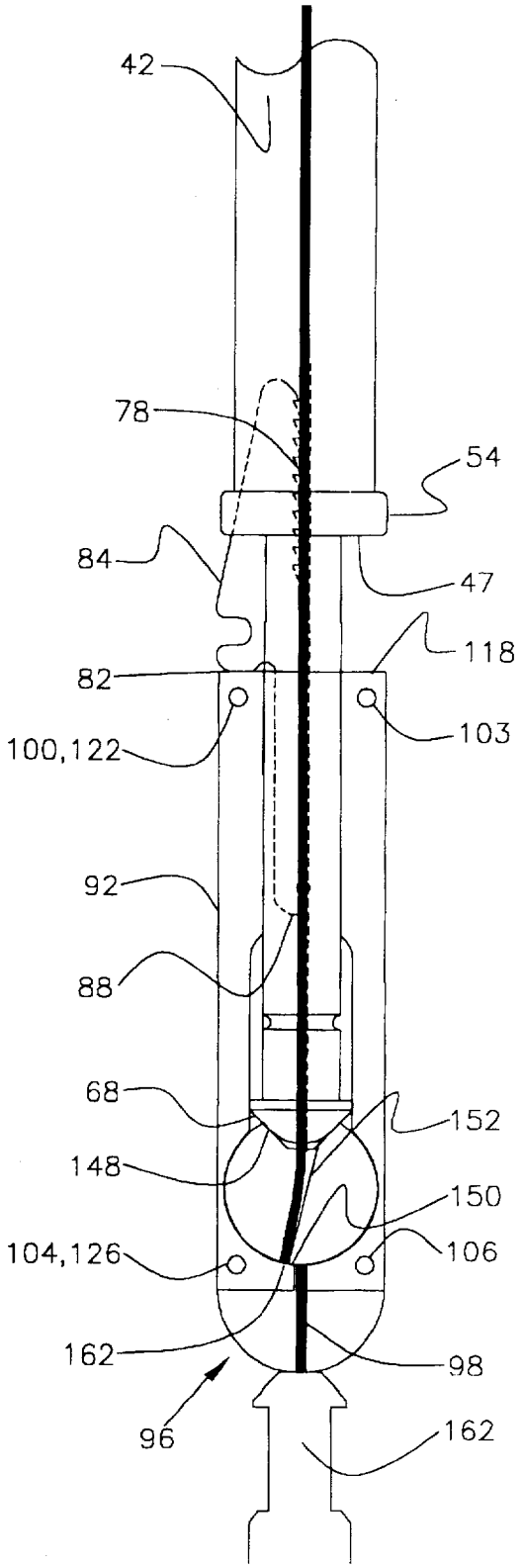
FIG. 7 is a cross-section of the invention in the gripping position.

Once the apparatus 4 is lowered into the well bore, it will continue falling until the apparatus 4 strikes the down hole object 162 as depicted in FIG. 6. The impact of the apparatus 4 against the down hole object 162 will shear the pin 115A so that the power mandrel 32 is now free to travel downward relative to the object 162. Other means of delivering an impact to the apparatus in order to shear the pin 115A are available such as jarring devices. The power mandrel 32, and in particular the activation means 68, will move towards the indention profile 148. As the conical surface of the activation means 68 moves into the indention profile 148, the indention profile 148 rotates. Remember, the skewed angle of the indention profile 148 with respect to the channel 152. The rotation of the indention profile 148 will in turn cause the cutting means 38 to rotate and the cutting blade 150 to rotate. The cutting blade 150 will be rotated into engagement with the wire line so that the wire line is severed.

As the conical surface 68 of the power mandrel 32 is rotating the cutting means 38 and cutting the wire line, the downward inertia of the tubular member 30 and power mandrel 32 will force the radial end 47 unto the angled surface 84 of the wire wedge member 40. As the radial end 47 continues to be urged downward, the border end 88 of the wire wedge member 40 will be brought into contact with the radial end 118 which aids in forcing the serrated gripping profile means 78 into the longitudinal mandrel slot 72 by providing an anchor for the downward force of the tubular member 30, and therefore, wedging the wire firmly into the longitudinal mandrel slot 72.

Thereafter, the operator may begin pulling on the wire line. As the operator is doing this, the apparatus 4 will also be lifted out of the well bore by simply pulling on the wire line since the wire line is wedged onto the apparatus 4. It should be noted that the weight of the power mandrel 32 and housing sections 34, 36 only tend to further engage the wire wedge member 40 due to the serrated gripping profile means 78.

Once the wire line and apparatus 4 are removed from the well bore, the operator may then utilize a retrieving tool (not shown) lowered via wire line in order to grasp the down hole object 162. Retrieving tools are well known in the art and are commercially available from Specialty Machine And Supply, Inc. Once the retrieving tool has latched onto the down hole object, the down hole object may be retrieved from the well bore.

Changes and modifications in the specifically described embodiments can be carried out without departing from the scope of the invention which is intended to be limited only by the scope of the appended claims.

I claim:

1. An apparatus for cutting a wire comprising:

a tubular member having an inner diameter for placement of the wire;

a mandrel having a slot therein for placement of the wire, said mandrel having a first end and a second end, said mandrel being attached to said tubular member;

a housing having said first end of said mandrel positioned therein, said housing having a first half and a second half, with the wire transversing said housing;

cutting means, positioned within said housing, for cutting the wire;

pin means, adapted within said housing, for selectively attaching said mandrel with said housing.

2. The apparatus of claim 1 further comprising:

a wire wedge member, positioned within the mandrel slot, adapted to wedge the wire into engagement with said mandrel.

3. The apparatus of claim 2 wherein said second end of said mandrel contains activating means for activating said cutting means into engagement with said wire.

4. The apparatus of claim 3 wherein said cutting means comprises a cutting blade disc having an indention profile formed thereon and a channel traversing said cutting blade disc, with said cutting blade disc being pivoted from a first position to a second position.

5. The apparatus of claim 4 wherein said activation means contains a conical member, and wherein said indention profile contained on said cutting blade disc is sized to accept said conical member.

6. The apparatus of claim 5 wherein said wire wedge member is adapted for inclusion into said longitudinal mandrel slot of said mandrel, and wherein said wedge forms an angled surface of increasing length having a short end and a long end with the first short end being adapted against the tubular member so that upon downward movement of the tubular member, said wire wedge member is driven into said longitudinal mandrel slot of said mandrel.

7. A method of cutting a wire attached to a down hole object, the down hole object being located in a well bore, the wire extending from the down hole object to the surface, the method comprising:

striping a cutting device onto the wire at the surface, said cutting device containing:

a tubular member having an inner diameter for placement of the wire; a mandrel having a slot therein for placement of the wire, said mandrel having a first end and a second end, said mandrel being attached to said tubular member; a housing having said first end of said mandrel positioned therein, said housing having a first half and a second half, with the wire traversing said housing; cutting means, positioned within said housing, for cutting the wire; a pin means for selectively attaching said mandrel into a latched position relative to said housing; a wire wedge member, positioned within the mandrel slot, adapted to wedge the wire into engagement with said mandrel; and activation means, located on said second end of said mandrel, for activating said cutting means, said activation means comprising a conical shaped end formed on said second end of said mandrel;

lowering said cutting device into the well bore;

impacting said cutting device against the down hole object;

shearing the pin means so that said mandrel is no longer attached to housing;

impacting said conical member against said cutting blade;

rotating said cutting blade so that said blade is urged against said wire;

cutting said wire.

8. The method of claim 7 wherein the step of shearing the pin means further includes:

having the tubular member travel downward relative to said wedge member;

forcing said wedge member into said longitudinal mandrel slot;

wedging the wire line against said mandrel.

9. The method of claim 8 further including the steps of:

pulling on said wire line;

retrieving said cutting device from said well bore.

10. The method of claim 9 wherein said down hole object is a down hole tool, and the method further comprises the steps:

providing a retrieving tool means for retrieving a down hole tool;

lowering said retrieving tool means into the well bore;

retrieving said tool from the well bore.

11. A device for cutting a wire line comprising:

a tubular member having an inner diameter therethrough for placement of the wire line;

a power mandrel having an a first end and a second end, with said first end being associated with said tubular member, said power mandrel having a mandrel slot therein for placement of the wire line;

a housing operatively associated with said mandrel, with said housing having a first end and a second end, with the first end receiving said mandrel and the second end having an outlet for the wire line, said housing containing an aperture;

a rotatable curing blade pivotally attached within said housing, and wherein said rotatable cutting blade comprises: a disc member having an indention profile formed thereon, with said indention profile leading to a channel traversing said disc member with said channel ending with a edge shaped to cut the wire: and a pivoting arm attached to said disc member, said pivoting arm being operatively associated with said housing;

activation means, operatively associated with said second end of said mandrel, for activating said rotatable cutting blade into engagement with said wire line selective attachment means for selectively attaching said power mandrel with said housing, and wherein the selective attachment means comprises: a pin adapted to be received within said aperture, said pin selectively attaching said housing with said mandrel; and, a wire wedge member, positioned within said mandrel slot and adapted to wedge the wire into engagement with said mandrel.

12. The device of claim 11 wherein said activating means comprises:

a conical shaped end formed on said second end of said mandrel, said conical end adapted to cooperation with said indention profile contained on said disc member so that as said conical end is lowered into said indention profile, said edge is rotated against said wire line.

13. The device of claim 12 wherein said wire wedge member is adapted for inclusion into said longitudinal slot of said mandrel, and wherein said wedge has a first short end and a second long end with the first short end being adapted against the tubular member so that upon downward movement of said tubular member, said wire wedge member is driven into said longitudinal slot of said mandrel.

* * * * *